United States Patent [19]

Howell, Jr. et al.

[11] 4,206,913

[45] Jun. 10, 1980

[54] TRICK WINDMILL NOVELTY

[76] Inventors: Earl A. Howell, Jr.; Earl A. Howell, III, both of 2139 Wilson Ave., Jacksonville, Fla. 32207

[21] Appl. No.: 934,974

[22] Filed: Aug. 18, 1978

[51] Int. Cl.[2] ..... A63J 23/00

[52] U.S. Cl. ..... 272/27 B

[58] Field of Search ..... 272/8 N, 27 R, 27 B, 272/27 W; 46/44, 56

[56] References Cited

U.S. PATENT DOCUMENTS

| | | | |
|---|---|---|---|
| 541,011 | 6/1895 | Rick | 272/27 B |
| 801,630 | 10/1905 | Anderson | 272/27 B |
| 824,561 | 6/1906 | Maschin | 272/27 B |
| 1,562,593 | 11/1925 | Schwartz | 272/27 B |
| 1,611,610 | 12/1926 | Reinfeldt | 272/27 B |

*Primary Examiner*—Harland S. Skogquist

[57] ABSTRACT

An amusement trick device for playing a practical joke on an unsuspecting person; the device including a can having a freely rotatable windmill wheel mounted thereabove on a support, an inner tube having a first end extending into a side of the can, the tube extending through the can, and its other end being directed against the windmill blades for rotation thereof, the inner tube first end being hidden inside an outer tube first end that extends only into the interior of the can, the inner tube having its first end, air intake opening hidden at a side of the outer tube, while the outer tube has its air intake opening at its terminal end, a quantity of finely powdered graphite being inside the can, and the can having a row of perforated openings on its side wall, near the can upper end and located above the sideward projecting tube first ends; so that a knowledgeable person covers the outer tube air intake opening with his tongue, and blows only into the air intake opening of the inner tube, so as to cause the windmill wheel to rotate, while an unsuspecting person blows directly into the end opening of the outer tube, thus developing air pressure inside the can, so as to cause the graphite to blow out of the can perforated openings, and produce a moustache on the person's face.

1 Claim, 2 Drawing Figures

TRICK WINDMILL NOVELTY

This invention relates generally to amusement trick devices.

A principal object of the present invention is to provide a trick windmill novelty, in which a windmill wheel is rotated by blowing into a correct tube, whereas blowing into a wrong tube will cause powdered graphite to be blown on a person's face, so as to produce the appearance of a moustache, to the amusement of all others observing the person trying to make the windmill work.

Another object is to provide a trick windmill novelty, in which the correct tube to be blown is hidden inside a wrong tube; the correct tube having its air intake opening hidden at a side of the wrong tube, while the wrong tube has its air intake opening exposed at its terminal end, so as to appear obviously the one to be blown in order to operate the windmill.

Other objects are to provide a trick windmill novelty which is simple in design, inexpensive to manufacture, rugged in construction, easy to use and efficient in operation.

Figure 1:
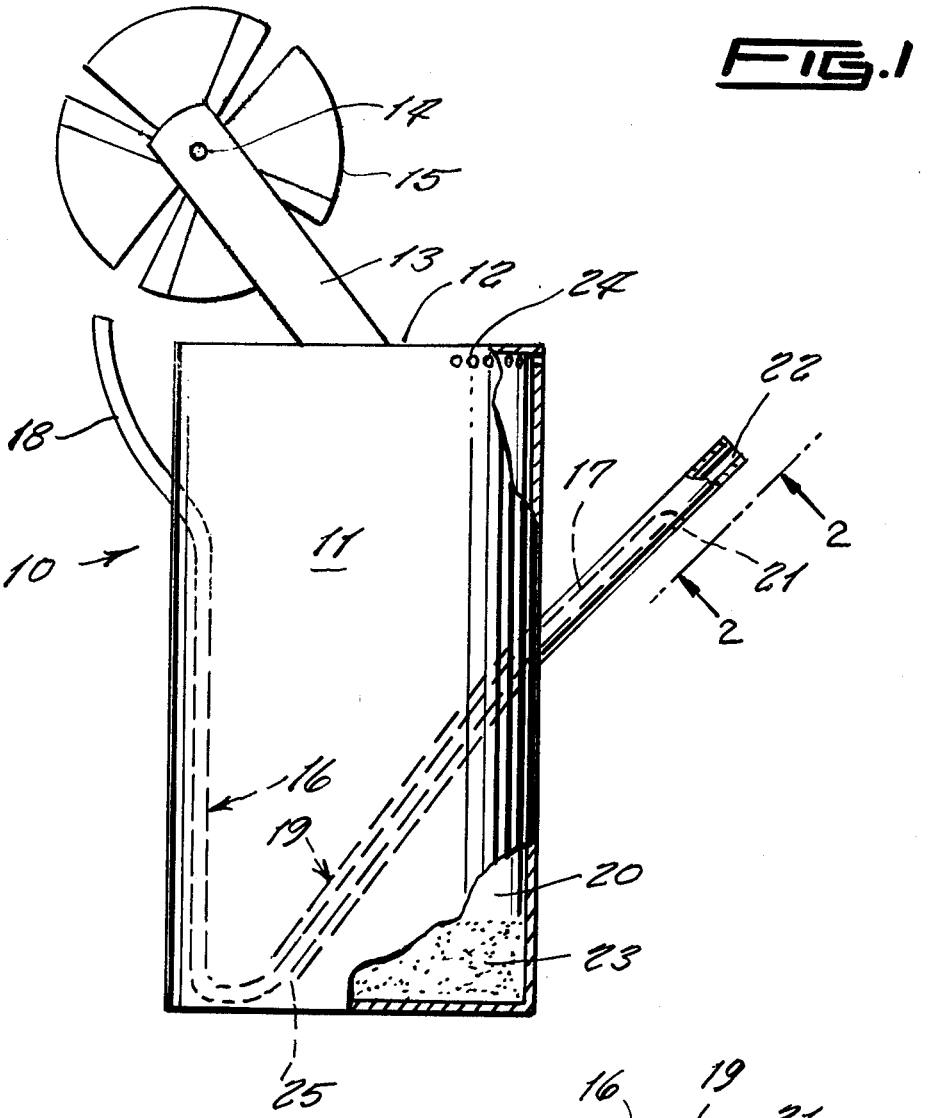
Figure 2:
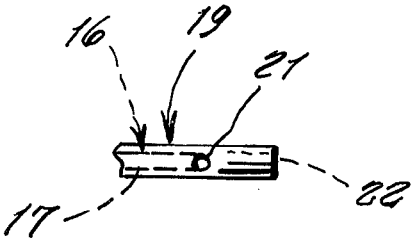

These, and other objects, will be readily evident, upon a study of the following specification, and the accompanying drawing, wherein:

FIG. 1 is a side view of the present invention, and shown partly in cross section so as to illustrate the interior thereof, and FIG. 2 is a view in direction 2—2 of FIG. 1.

Referring now to the drawing in greater detail, the reference numeral 10 represents a trick windmill novelty, according to the present invention, wherein there is a cylindrical tin can 11, which, upon its upper end 12, has a pair of posts 13 secured thereto, and which are made of metal strips. The posts support a pin 14 therebetween, and a windmill wheel 15 is supported to rotate freely on the pin.

A first, or inner, tube 16 projects at its first end 17 from one side of the can, the tube extending through the interior of the can, and out at its opposite end 18, which is directed toward the wheel 15, so as to rotate the same, when air is blown through the tube.

A second, or outer, tube 19 is located around the first end 17 of the inner tube 16, so as to hide the same; the outer tube terminating within the interior 20 of the can.

The inner tube has an air intake opening 21, that is located hidden on a lower side of the outer tube, whereas the outer tube has an air intake opening 22, that is located at the terminal end thereof, so as to be readily visible.

A quantity of powdered graphite 23 is contained within the can.

A row of perforated openings 24 are located on a side of the can, and near an upper edge thereof; the row of openings 24 being located above the sidewardly projecting tubes, so as to face toward a person when blowing into the tubes.

In operative use, in order to play a trick on an unsuspecting person, perhaps a person with knowledge of the trick will demonstrate first, so as to drive the windmill wheel, by placing the sidewardly protruding tube in his mouth and blowing air. But he does not reveal that he covers the outer tube opening 22 with his tongue, and blows into the opening 21 of the inner tube. Thus, air causes the wheel to rotate.

Then, the other person, new to the trick, tries to do the same. He sees the opening 22 in the end of the tube, and believes this is the entry for the air, the other opening 21 being not readily seen, due to its out-of-the-way underside location. Thus, when he blows through outer tube 19, so as to increase the air pressure inside the can, resulting in air rushing out of the preforated openings 24, and carrying with it some of the graphite powder raised by the blowing air coming from the tube outlet located among the powder, so that a deposit of the graphite dust is made under a person's nose, so as to produce a "moustache".

The can may be re-filled, with graphite being poured down the outer tube 19, whenever needed.

While various changes may be made in the detail construction, it is understood that such changes will be within the spirit and scope of the present invention, as is defined by the appended claims.

What I now claim is:

1. A trick windmill novelty, comprising, in combination, a can, a pair of posts upon an upper end of the can, a pin supported between said posts, and a windmill wheel freely pivoted on said pin, a quantity of graphite powder inside said can, a tube assembly protruding at one end from a side of the can, a row of perforated openings in a side of said can located above said sidewardly protruding end of said tube assembly, and means whereby said tube assembly selectively drives said wheel to rotate or said graphite powder to blow out of said perforated openings, said means comprising said tube assembly, consisting of an inner tube and an outer tube, said inner tube extending from said sidewardly protruding end, through said can and out at an opposite side, where it is directed toward said wheel, and said outer tube extends from said sidewardly protruding end ito an interior of said can; said outer tube being located around an outer side of said inner tube, said inner tube having an air intake opening located on a side of said outer tube, while said outer tube has an air intake opening located at its outward end.

* * * * *